US005171090A

United States Patent [19]

Wiemers

[11] Patent Number: 5,171,090

[45] Date of Patent: Dec. 15, 1992

[54] DEVICE AND METHOD FOR DISPENSING A SUBSTANCE IN A LIQUID

[76] Inventor: Reginald A. Wiemers, 1201 S. Emerson, Denver, Colo. 80210

[21] Appl. No.: 665,307

[22] Filed: Mar. 5, 1991

Related U.S. Application Data

[60] Division of Ser. No. 516,759, Apr. 30, 1990, Pat. No. 5,145,256, and a continuation-in-part of Ser. No. 516,759, Apr. 30, 1990, Pat. No. 5,145,256.

[51] Int. Cl.[5] ..... B01F 5/04

[52] U.S. Cl. ..... 366/165

[58] Field of Search ..... 417/171, 163; 366/165, 366/336; 210/199, 249; 239/10, 311, 318, 399, 427.3, 427.5, 428.5

[56] References Cited

U.S. PATENT DOCUMENTS

| | | | |
|---|---|---|---|
| 2,211,795 | 8/1940 | Sauer | 417/174 |
| 2,653,801 | 9/1953 | Fontein et al. | 366/165 |
| 3,099,965 | 8/1963 | Regenscheit | 417/171 |
| 3,298,669 | 1/1967 | Zingg | 239/318 |
| 4,218,012 | 8/1980 | Hamza et al. | 366/165 |

FOREIGN PATENT DOCUMENTS

| | | | |
|---|---|---|---|
| 2705501 | 8/1978 | Fed. Rep. of Germany | 366/165 |
| 3316233 | 11/1984 | Fed. Rep. of Germany | 417/171 |
| 1373905 | 2/1988 | U.S.S.R. | 417/171 |

*Primary Examiner*—Bernard Nozick

*Attorney, Agent, or Firm*—Harold A. Burdick

[57] ABSTRACT

A device for dispersing a substance, for example, dry particulate material, in a liquid is disclosed having a funnel eductor for distributing and carrying the substance in a flow stream and a cyclonic dispersal eductor for inducing the flow stream and introducing the flow stream having the particulate matter therein into a spirally moving liquid flow stream. The dispersal eductor preferably includes first and second liquid input ports defining first and second dispersal stages, respectively, with the substance, in liquid, output from the first stage being introduced into the liquid being input through the second liquid port at the second stage, each port being positioned so that a spiralling liquid flow is imparted, liquid flow at the second stage being counter-rotational relaive to liquid flow in the first stage.

18 Claims, 6 Drawing Sheets

DEVICE AND METHOD FOR DISPENSING A SUBSTANCE IN A LIQUID

RELATED APPLICATION

This application is a Divisional/Continuation-In-Part Application of pending U.S. patent application Ser. No. 07/516,759 now U.S. Pat. No. 5,145,256 Entitled "APPARATUS AND METHOD FOR TREATING EFFLUENTS", Filed Apr. 30, 1990.

FIELD OF THE INVENTION

This invention relates to devices and methods for mixing substances, and, more particularly, relates to devices and methods for dispersing substances, such as particulate matter, in liquid.

BACKGROUND OF THE INVENTION

While any number of devices are known for mixing various substances in liquid, some potential applications for which such devices could be utilized present particular requirements which have not always been adequately addressed by heretofore known mixers. For example, where uniformity of concentration, and thus dispersal, of a substance in a liquid medium, careful control of shear rates in the mixing operation, or where the substance to be dispersed in the liquid presents particular difficulty in wetting, higher degrees of control over dispersal, shear rates, and thorough wetting capability are desirable.

In other applications, it is desirable for such mixers to have a minimum of, or to entirely eliminate, moving parts, to be easily disassembled for maintenance and cleaning, and/or to be capable of operation over a relatively large operating pressure and/or throughput range.

By way of example, it is known that, when utilizing substances, such as polymers, in dry form as a coagulant, flocculent or the like (for example products produced by Allied Colloids Company such as the trademark products Percols 351, E-24, E-10, 155, 156, 721, 728, 753 and 788N), preparation of a concentrated stock solution is desirable to assure proper activation of the polymer in its liquid phase (for example water). It would be desirable therefore, during this polymer dispersion process, for the polymer particles utilized to be prewetted to decrease the dispersion time and prevent the formation of lumps (known as fisheyes) of the polymer material which dissolve very slowly, if at all, due to formation on the outer surface of such lumps of a highly viscous gel which resists passage of liquid necessary for further wetting of the polymer. While the need in various water purification processes for adequate dispersal of polymers in their aqueous phase is recognized, apparatus for achieving such goals have not always proved effective, and further improvement therein could still be utilized.

SUMMARY OF THE INVENTION

An improved device and method for dispersing a substance in a liquid (for example for dispersing polymer granules, or particles, in water in preparation for injection thereof into an effluent) is provided by this invention which has a first flow conductor for conducting a spiralling flow of liquid and input for conducting a flow of the substance and introducing the substance tangentially into the spirally flowing liquid to thus distribute the substance in the liquid. The device requires no moving parts and is readily disassembled for cleaning.

The device, when used, for example, to disperse particulate matter in a liquid, includes a particle distributing and separating portion for distributing and separating particles in an air flow stream, and a flow inducing and conducting portion connected with the particle distributing and separating portion for inducing the air flow through the particle distributing and separating portion and for spirally conducting a liquid flow stream through the flow inducing and conducting portion, the air flow stream having the particles therein being tangentially introduced into the spirally moving liquid flow stream at one part of the flow inducing and conducting portion.

The particle distributing and separating portion includes an air funnel having an outlet for directing an air flow therethrough, a particle funnel for receiving the particles and having the outlet of the air funnel positioned adjacent thereto, the particle funnel having an outlet, and an air flow control cap for controlling air flow to the air funnel. The flow inducing and conducting portion includes a housing having an inner wall defining a cone with an outlet defined therein at the bottom part of the cone, and a liquid feed stem opening into an upper part of the cone at a position so that liquid entering the cone through the feed stem is spirally directed in the cone toward the outlet. A nozzle is connected with the outlet of the particle funnel and includes an outlet port positioned adjacent to the bottom part of the cone.

The device desirably includes first and second dispersing stages, the first stage for dispersing the substance in the liquid, and the second stage for introducing the liquid having the substance dispersed therein into a second spiralling liquid flow stream, the spirally flowing liquid at the second stage flowing counter-rotationally relative to the spirally flowing liquid at the first stage.

It is therefore an object of this invention to provide an improved device for dispersing a substance in a liquid.

It is another object of this invention to provide a device for dispersing a substance in a liquid having first and second stages, with each stage having means for conducting a spiralling flow of liquid, with the spiralling flow of liquid at the first stage being counter-rotational relative to the spirally flowing liquid at the second stage.

It is still another object of this invention to provide a device for dispersing particles in a liquid which includes a particle distributing and separating portion for distributing and separating the particles in an air flow stream, and a flow inducing and conducting portion connected with the particle distributing and separating portion for inducing the air flow through the particle distributing and separating portion and for spirally conducting a liquid flow stream through the flow inducing and conducting portion.

It is yet another object of this invention to provide a device for dispersing a substance in a liquid which includes a liquid flow conducting portion for spirally conducting a flow of liquid and having a liquid inlet and an outlet, and an input portion for conducting a flow of the substance, the input portion being connected with the flow conducting portion and having an outlet port positioned for tangentially introducing the substance into the spirally flowing liquid.

It is still another object of this invention to provide a device for dispersing a substance in a liquid having first and second liquid flow conducting portions each for spirally conducting a flow of liquid and each having a liquid inlet and outlet, the spiralling flow of liquid conducted in each of the first and second flow conducting portions being counter-rotational relative to one another, and first and second input portions, the first input portion for conducting a flow of the substance and having an outlet for tangentially introducing the substance into the spirally flowing liquid at the first flow conducting portion, and the second input portion being connected to the outlet of the first flow conducting portion and having an outlet port for tangentially introducing the liquid having the substance dispersed therein at the first flow conducting portion into the spirally flowing liquid at the second liquid flow conducting portion.

It is yet another object of this invention to provide a device for dispersing substantially dry particles in a liquid which includes adjacent air and particle funnels, an air flow control cap for controlling air flow to the air funnel, a housing having an inner wall defining a cone and an outlet therein at the bottom part of the cone and having a liquid feed stem opening into an upper part of the cone at a position so that liquid entering the cone through the feed stem is spirally conducted in the cone toward the outlet, and a nozzle connected with the outlet of the particle funnel and having a port positioned adjacent to the bottom part of the cone.

It is still another object of this invention to provide an improved method for dispersing a substance in a liquid.

It is yet another object of this invention to provide a method for dispersing a substance in a liquid which includes the steps of providing a flow of the substance, spirally conducting a liquid flow, and tangentially introducing the flow of the substance into the spiralling liquid flow.

With these and other objects in view, which will become apparent to one skilled in the art as the description proceeds, this invention resides in the novel construction, combination, arrangement of parts and method substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
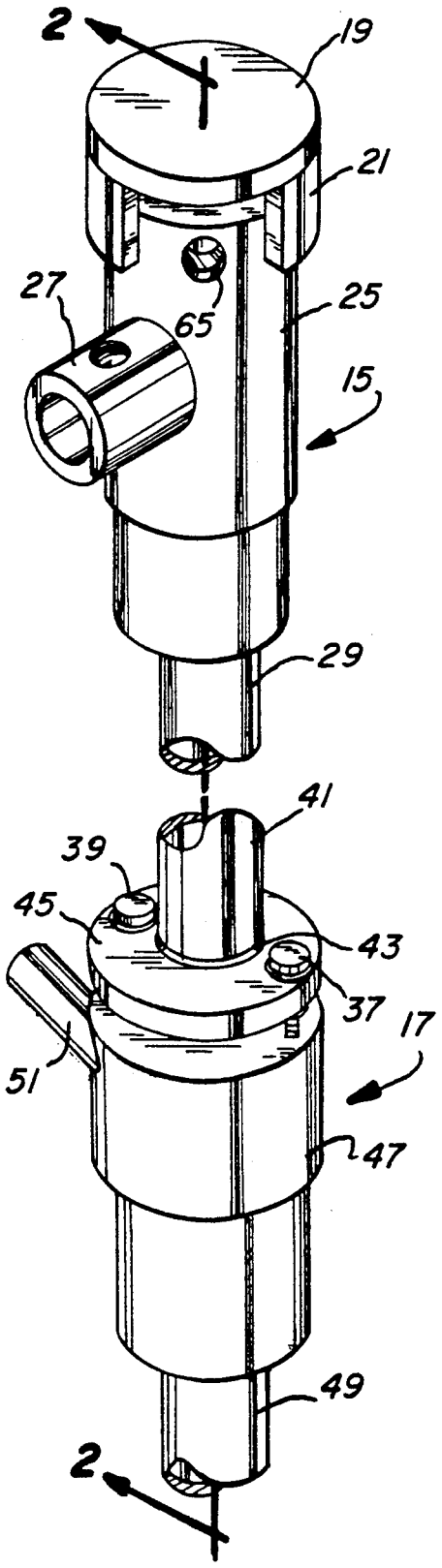
FIG. 1 is a perspective view of a first embodiment of the of the dispersing device of this invention.
Figure 2:
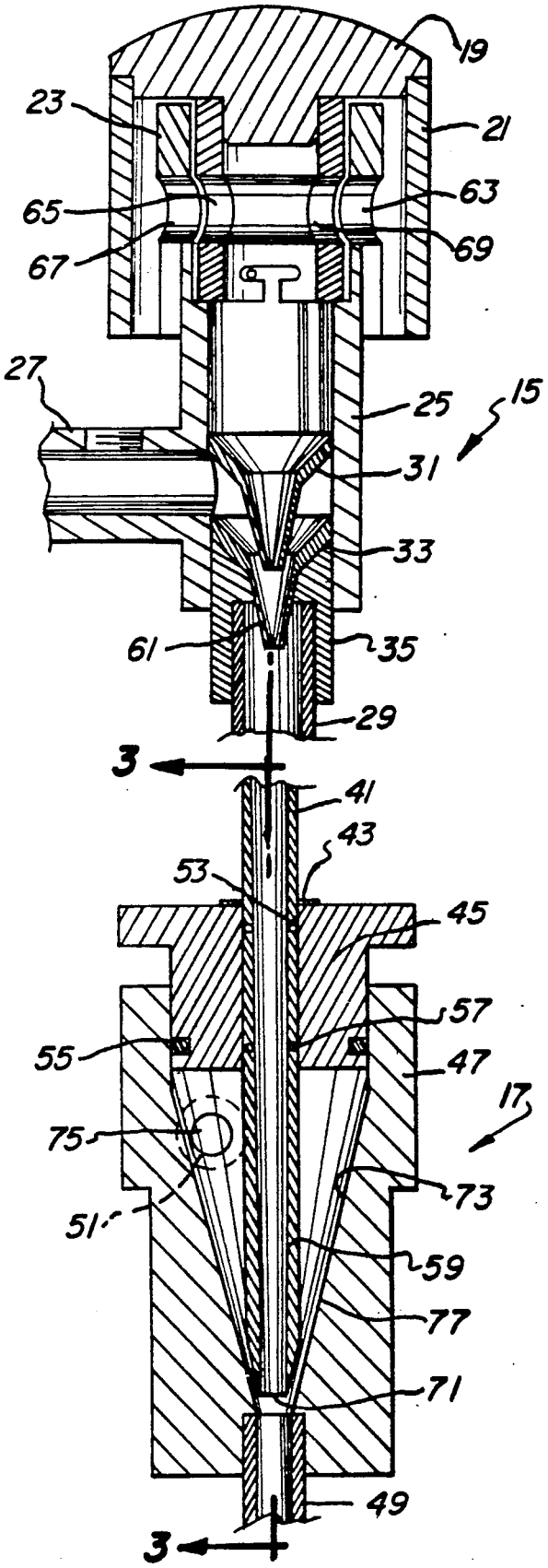
FIG. 2 is a sectional view taken through section lines 2—2 of FIG. 1.
Figure 3:
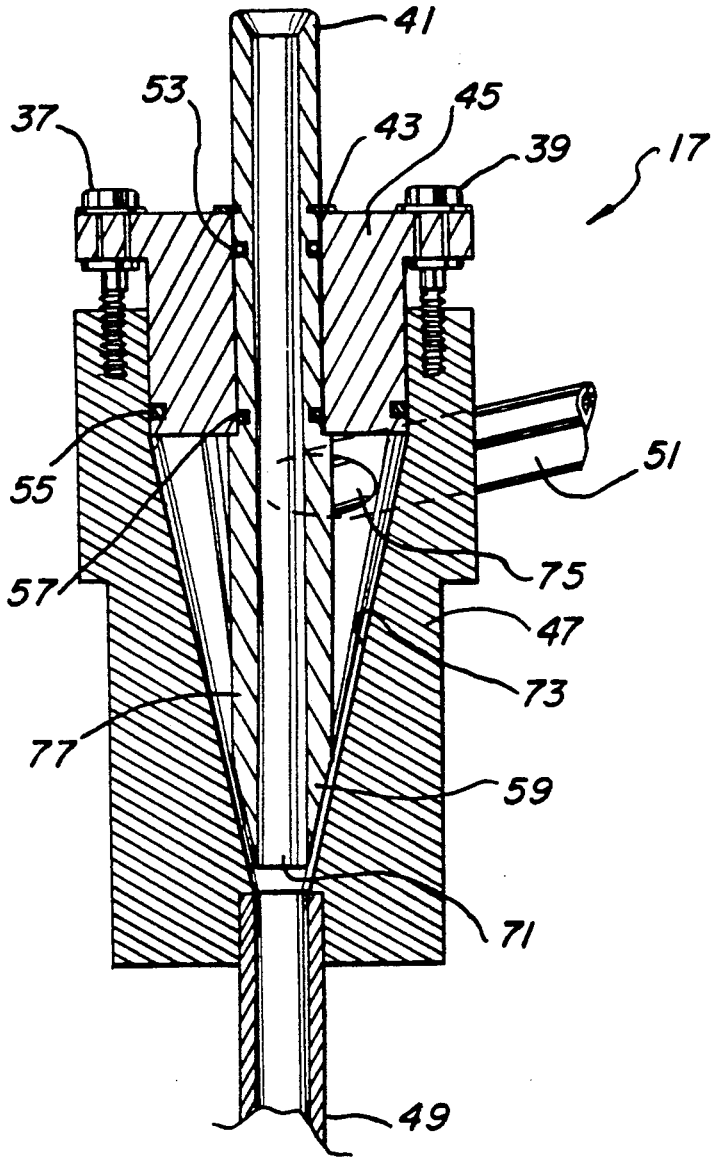
FIG. 3 is a sectional view taken through section lines 3—3 of FIG. 2.
Figure 4:
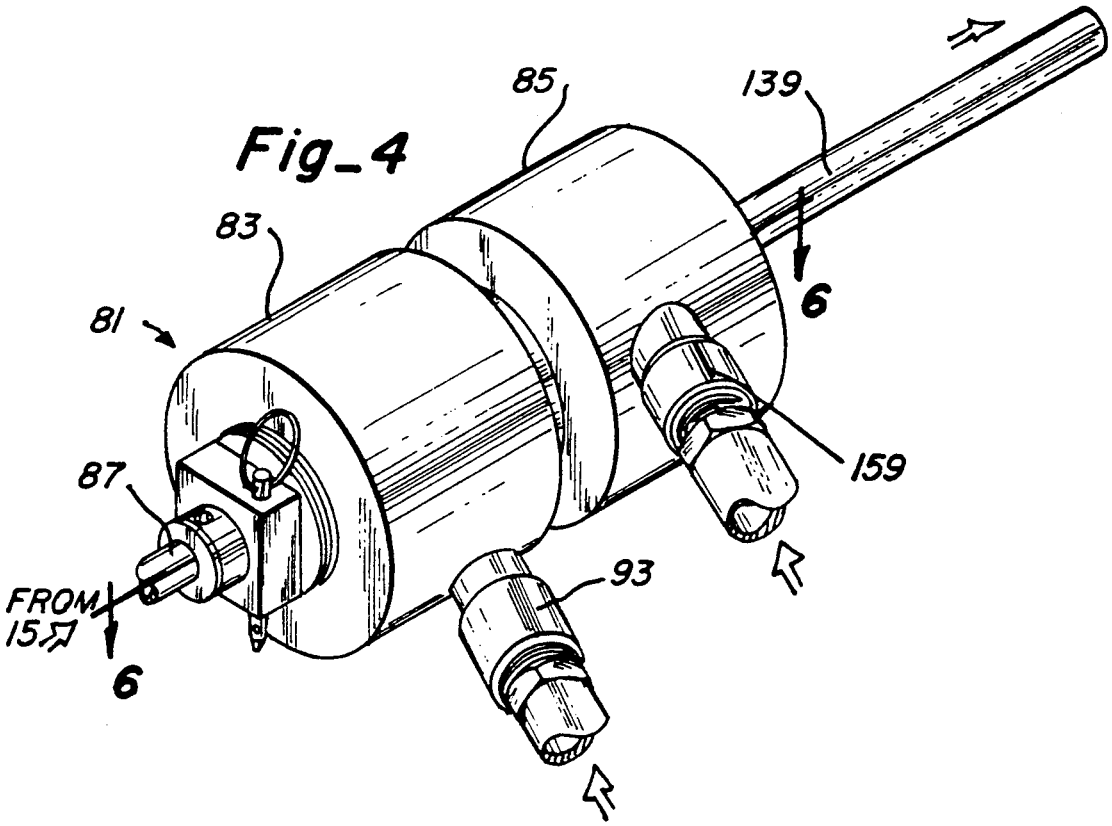
FIG. 4 is a perspective view of a second embodiment of the dispersing device of this invention.
Figure 6:
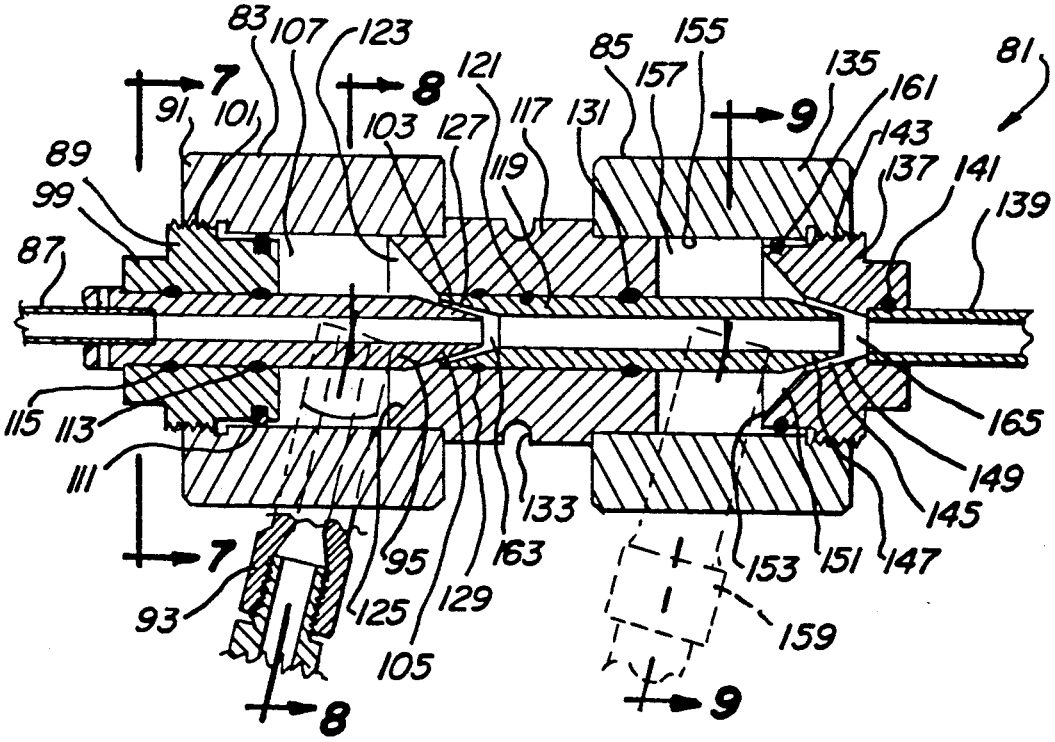
FIG. 6 is a sectional view taken through section lines 6—6 of FIG. 4.
Figure 5:
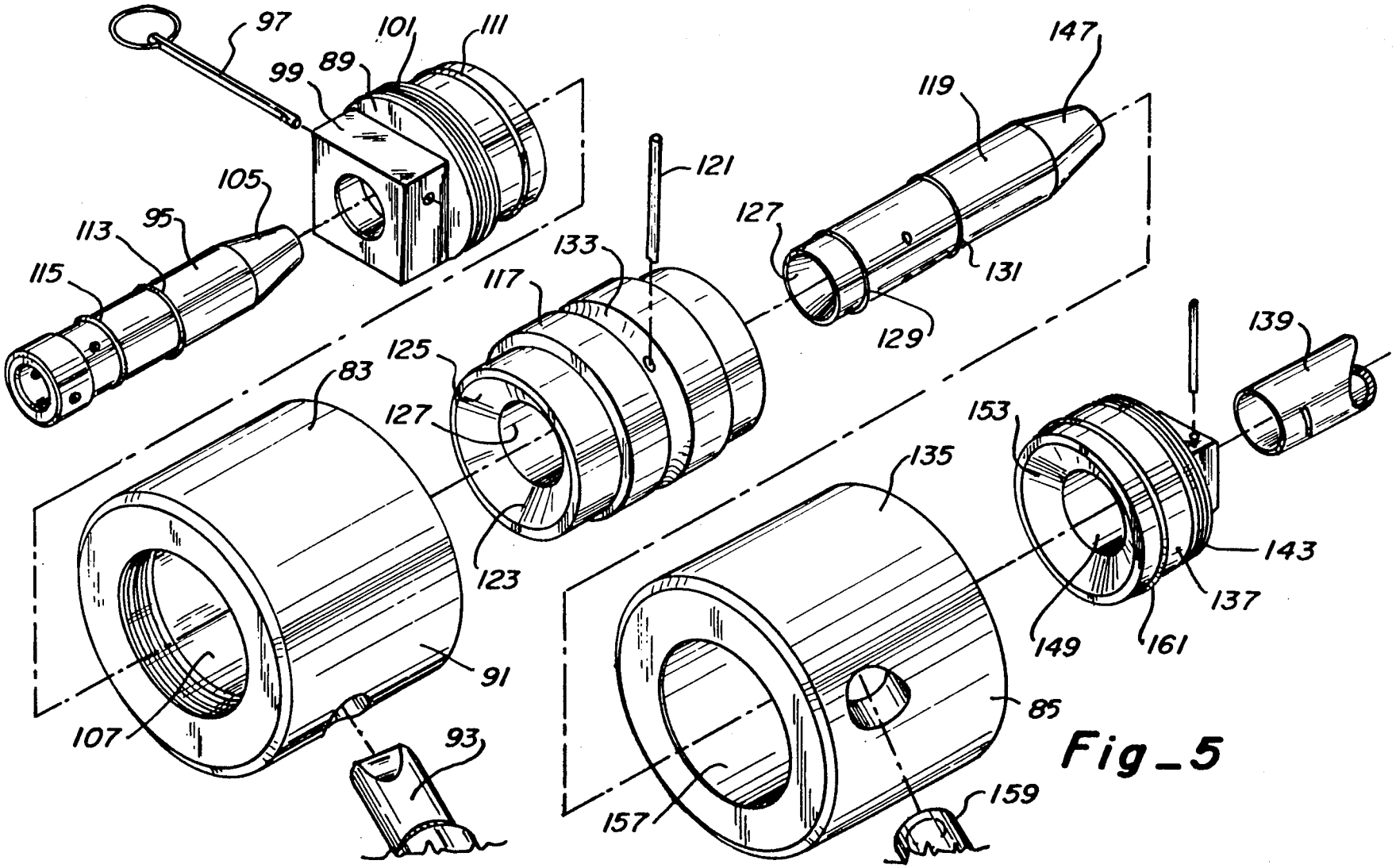
FIG. 5 is an exploded view of the device of FIG. 4.

FIGS. 1 through 3 illustrates a first embodiment of the disperser of this invention which includes funnel eductor 15 and dispersal eductor 17. The disperser illustrated in FIGS. 1 through 3 provides a system wherein solid granulated or powdered particles are separated and lifted by air flow and carried into a liquid feed stream where the solid and liquid combine to become a homogeneous stream. Funnel eductor 15 distributes the dispersant particles in the air flow and dispersal eductor 17 serves to both mix the air/dispersant stream with the liquid feed stream and to create a vacuum which provides the air flow through funnel eductor 15.

Figure 10:
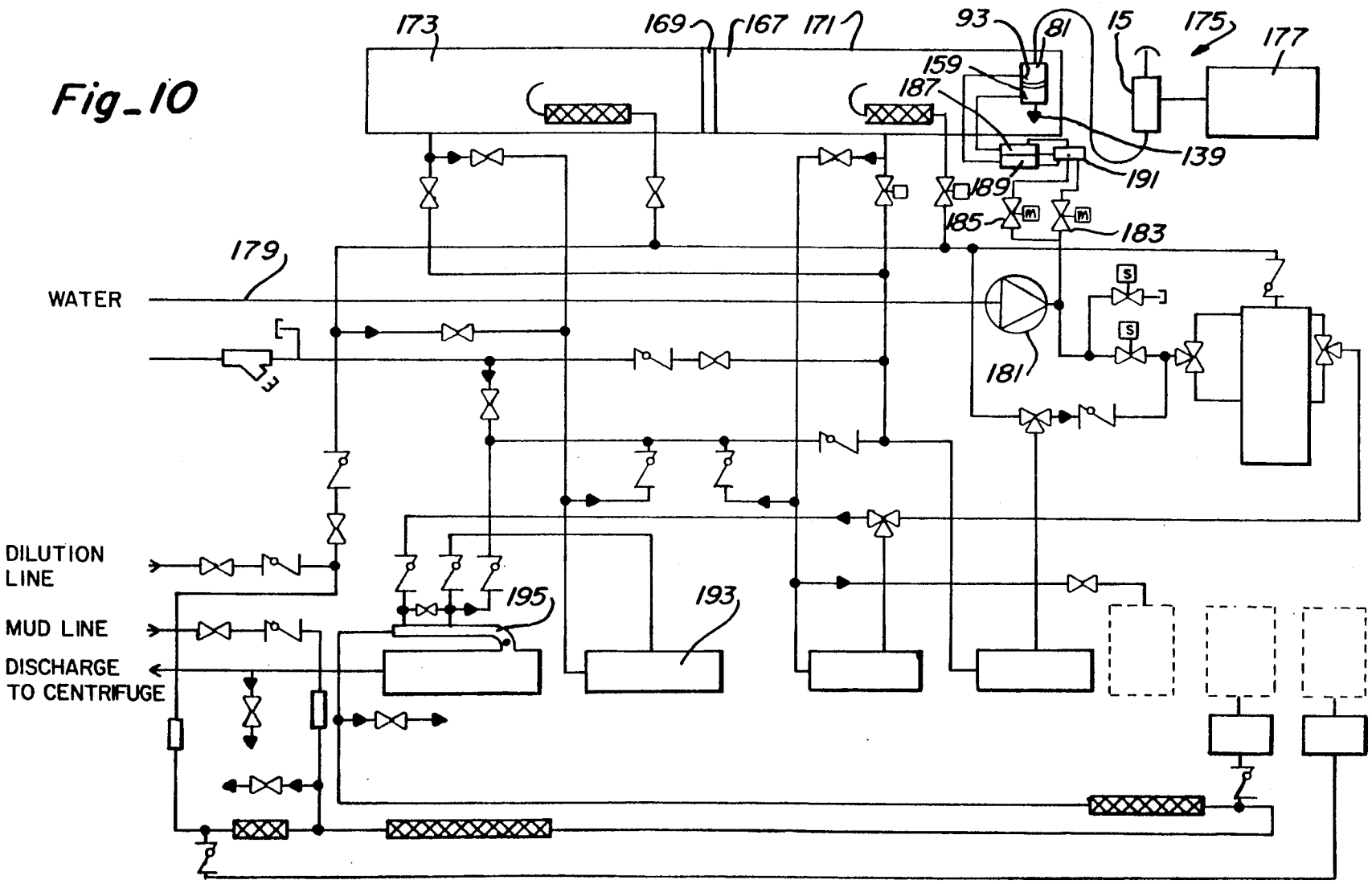
FIG. 10 is a schematic diagram illustrating the device of this invention in a system.

Funnel eductor 15 includes breather cap 19 having rotatable cap 21 and stationary breather body 23, eductor body 25 having dispersant in-feed conduit connector 27 connected therewith (for example for connection to an input line from a hopper/auger/feeder as illustrated in FIG. 10), lift, or connector, hose 29, air funnel 31 and dispersant feed funnel 33. Funnels 31 and 33 each have an upper conical portion and an outlet, funnel 31 being normally fixed and feed funnel 33 preferably being adjustable axially in body 25 to accommodate particles having different sizes. Lower lift hose plug 35 connects with lift hose 29 and eductor body 25.

Dispersal eductor 17 induces the air flow and conducts the liquid feed stream, and includes adjustment screws 37 and 39, input nozzle 41 (connected with lift hose 29), retainer ring 43, venturi nozzle body 45, disperser body 47 and discharge pipe 49. Tangential inclined feed stem 51 (for example inclined 15° from the horizontal as illustrated in FIG. 3) is connected to disperser body 47 and to the fluid source (for example to an incoming valved water line as shown in FIG. 10). The various parts may be made of suitable materials, for example piping of stainless steel, inlet connectors of Teflon, and nozzle bodies and housings of PVC, metal or other suitable materials given the application.

O-rings 53, 55 and 57 are provided to seal the interfaces of venturi nozzle body 45, input nozzle 41, and disperser body 47. Venturi nozzle 59 is adjustable within the housing axially by movement of adjustment screws 37 and 39.

Air funnel 31 directs the flow of particulate solids discharged, for example from the hopper/feeder as illustrated in FIG. 10 through in-feed conduit 27, into a ring-shaped flow around feed funnel nozzle exit 61. The vacuum created by the cyclonic flow of fluids in disperser body 47, and the venturi effect at the outlet end of venturi nozzle 59 of the disperser, pulls the solid polymer particles out of funnel eductor 15 thus distributing and separating the particles in the air flow.

Air flow can be regulated at breather cap 19 by more nearly aligning or closing air intake apertures 63, 65, 67 and 69. In addition, while not specifically shown herein, funnel eductor 15 may be equipped with an adapter for an optional blower which can be used for more forceful air flow and liquid agitation at eductor 17.

Venturi nozzle 59, preferably made of Teflon, forces the flow of the particulate stream in an axial direction at its outlet port 71 inside cyclone cone wall 73 of disperser body 47. A liquid feed stream is provided through inlet port 75 of feed stem 51 and as it enters the venturi a vacuum is created. Feed stem 51 feeds the liquid tangentially and angled downwardly into cone 77 of disperser body 47 thus producing a cyclone flow in cone 77 along cone wall 73. A pressure gauge and vacuum manometer may be provided for measuring and monitoring fluid feed pressure level and the vacuum at the air/dispersant flow stream, respectively.

Since the liquid feed stream and the dispersant stream are introduced in the disperser body tangentially to one another, and since the fluid enters the cone shaped bore tangentially, thus maintaining a spiral flow of the fluids around the cone wall, prewetting potential of the airborne and separated dispersants introduced through funnel eductor 15 into disperser eductor 17 is enhanced and optimized, such as is desirable for example where the dispersants are polymer materials being introduced for dispersal in a liquid phase.

FIGS. 4 through 9 illustrate a second embodiment 81 of the device of this invention, device 81 including first dispersing stage 83 and second dispersing stage 85. Dispersing stages 83 and 85 are each similar in many regards to dispersal eductor 17 described heretofore, but with the second dispersing stage 85 receiving the liquid having the particulate substance introduced therein from dispersing stage 83 for introduction into a second cyclonic liquid flow stream.

Device 81 includes substance input line 87, connected, for example, as heretofore described to funnel eductor 15 for receipt of the substance of interest therethrough. Dry particulate matter is self-conveyed in the device by the venturi action created as previously described by the reduced cross sectional flow area at the lower portion of the cone. However, this self-conveying property of the device is improved by the arrangement illustrated in FIGS. 4 through 9. True venturi action (creation of a pressure differential between the inlet and outlet of a pipe having an interval of reduced diameter thus increasing velocity of fluid flow) is inhibited where cyclonic flow occurs in a pipe, centrifugal forces causing the fluid flow towards the pipe wall thus creating an "eye" in the cyclonic flow which allows at least some pressure equalization. As will be seen as this description proceeds, device 81 maximizes the desired venturi effect while maintaining overall cyclonic flow.

Figure 7:
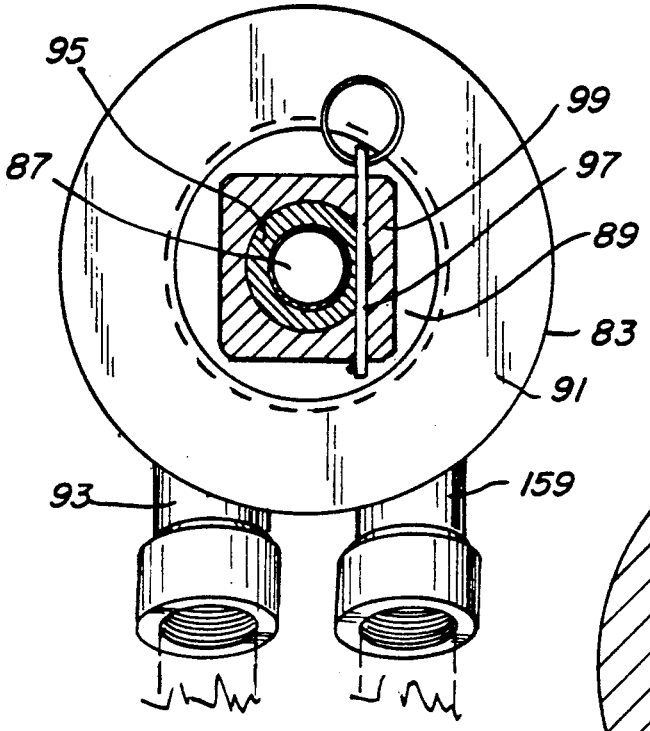
FIG. 7 is a sectional view taken through section lines 7—7 of FIG. 6.
Figure 9:
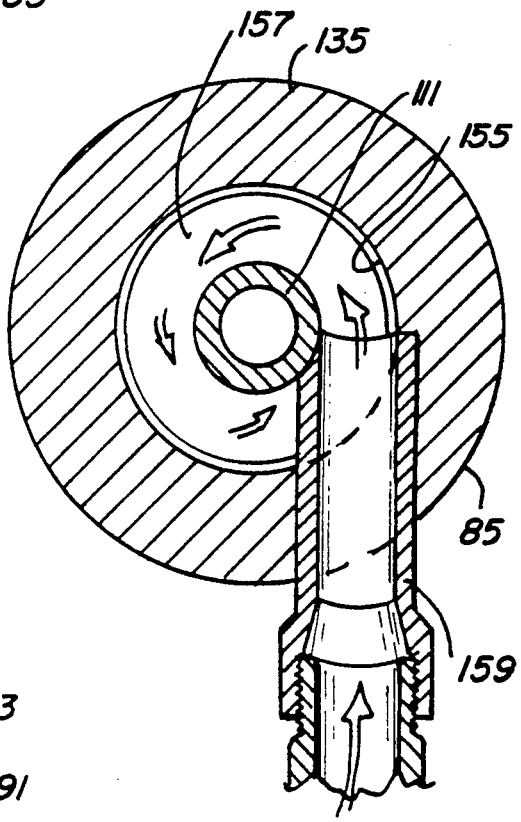
FIG. 9 is a sectional view taken through section lines 9—9 of FIG. 6.

First dispersing stages 83 includes venturi nozzle body 89, disperser body 91, and tangential inclined feed stem 93 (connected with a source of fluid, for example water). Venturi nozzle 95 is maintained in nozzle body 89, for example utilizing release pin 97 (as shown in FIG. 7) through squared portion 99 of nozzle body 89 thus allowing quick release for cleaning purposes and the like of venturi nozzle 95 from nozzle body 89. Nozzle body 89, and thus venturi nozzle 95, is adjustable in disperser body 91 utilizing matable threaded engagement 101. With a wrench positioned on squared portion 99 of venturi nozzle body 89, turning of the nozzle body adjusts the size of restricted flow passage 103 adjacent to tapered outlet end 105 of venturi nozzle 95 thus providing control over the amount of pressure differential exhibited between the bottom and top of the venturi nozzle.

Figure 8:
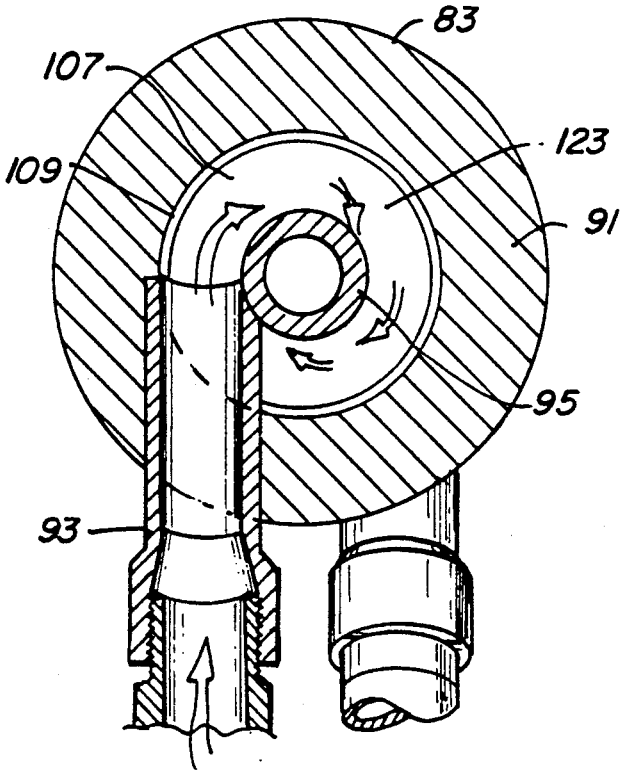
FIG. 8 is a sectional view taken through section lines 8—8 of FIG. 6.

As best illustrated in FIG. 8, inclined feed stem 93 extends into chamber 107 of disperser body 91, entering the chamber, for example, at an incline of approximately 15° and tangentially to wall 109 of chamber 107 and the outer circumference of a central portion of venturi nozzle 95. Seal 111 seals chamber 107 between the interface of nozzle body 89 and disperser body 91. Seals 113 and 115 seal the interface of venturi nozzle 95 and venturi nozzle body 89.

First and second disperser stages 83 and 85 are maintained in engagement by intermediate nozzle body 117 having venturi nozzle 119 maintained therein (for example using quick release pin 121). Intermediate nozzle body 117 includes cone 123 having cone wall 125, cone 123 defining the lower portion of chamber 107 for spirally conducting liquid to restricted flow passageway 103. Passageway 103 is defined between tapered outlet end 105 of venturi nozzle 95 and conical upper bore 127 in venturi nozzle 119. Seals 129 and 131 are provided for sealing the interface between intermediate nozzle body 117 and venturi nozzle 119. Intermediate nozzle body 117 includes groove 133 for bracket mounting of the device.

Intermediate nozzle body 117 is maintained in disperser body 91, for example by press fitting, and is maintained in lower disperser body 135 utilizing a similar suitable arrangement. Second dispersing stage 85 includes disperser body 135, adjustable discharge pipe body 137 having discharge pipe 139 maintained thereat, for example utilizing quick release pin 141. Discharge pipe body 137 is adjustable in disperser body 135 utilizing a matable threaded interface 143 in a similar fashion to that described with regard to interface 101 to thus adjust the size of restricted flow passageway 145 adjacent to tapered outlet end 147 of venturi nozzle 119 and conical bore 149 of discharge pipe body 137.

Cone 151 having cone wall 153 is formed at an upper portion of discharge pipe body 137, together with chamber walls 155 of chamber 157 defining a conducting surface for cyclonic (downwardly spiralling) flow of fluid similar to that described with respect to cone 123. Tangentially inclined feed stem 159 enters chamber 157 through disperser body 135 (again desirably at an incline of approximately 15°) tangentially to chamber wall 155 and the wall of venturi nozzle 119. Sealing ring 161 is provided to seal the interface between wall 155 of disperser body 135 and the outer wall of discharge pipe body 137.

As may be appreciated from the foregoing, fluid entering inclined feed stem 93 is conducted in a downwardly spiralling flow to the passageway 103 thus creating the venturi effect utilized for drawing substance through input pipe 87, and thus venturi nozzle 95, for introduction of the substance tangentially into the spiralling flow at opening 163 to venturi nozzle 119. Liquid entering through incline feed stem 159 is conducted in a downward spiral to passageway 145 so that the liquid having substance dispersed therein received through venturi nozzle 119 is tangentially introduced into the spiralling flow at opening 165 to discharge pipe body 137. However, since the spiralling flows within chambers 107 and 157 are counter-rotational relative to one another, the shear forces exerted on the substances of interest and the liquid at opening 165 effectively close the "eye" of the cyclonic flow thus enhancing the venturi effect through funnel eductor 15, inlet pipe 87, venturi nozzle 95 and venturi nozzle 119.

In operation, the venturi action exhibited at the outlet from venturi nozzle 95 creates a pressure differential between the bottom of the nozzle and the top of the nozzle (at input pipe 87 from eductor 15). Thus, in first dispersing stage 83 the substance (for example dry polymers lifted into an air stream as heretofore set forth) is drawn through venturi nozzle 95 by the pressure differential. The substances thus carried are introduced into the liquid provided through inclined feed stem 93 tangentially to the spiralling flow of the liquid. The spiralling stream of liquid enters the central bore of venturi nozzle 119 (the flow within venturi nozzle 119 maintaining its spiralling motion) and is introduced at opening 165 tangentially into the counter-rotational spiralling liquid introduced at second dispersing stage 85 through tangential inclined feed stem 159. Due to increased turbulence and shear, pressure is thus not allowed to equalize through the center of the spirally flowing liquid and the differential pressure through the stages is increased. In addition, the counter-rotational motion of the two flows introduced at opening 165 creates a hydrodynamic shear zone, with the amount of shear being controlled by independently adjusting the flow of water (for example using standard valves or the like) through the upper and lower incline feed stems.

For example, such a shear will cause polymer particles to stretch and shear, thus exposing a larger area of the polymer to the liquid and further enhancing the wetting of the polymer. By adjusting the flow through the upper and lower tangential incline feed stems, the desired level of prewetting and the desired level of shear may be controlled. It is apparent, of course, that additional shear zones are possible merely by adding consecutive stages, with each additional stage having counter-rotational liquid flow relative to the prior stage.

Maximum prewetting occurs where there is a maximum flow through tangential incline feed stem 93 and a minimum flow through tangential incline feed stem 159. Minimum wetting occurs where there is minimum flow through feed stem 93 and maximum flow through feed stem 159 (each condition of course being dependent upon a relatively constant flow and pressure through the pump supplying liquid to the feed stems).

Maximum shear is accomplished by providing maximum flow at both stages through feed stems 93 and 159. Minimum shear is accomplished by providing maximum fluid flow in stage 83 through feed stem 93 and minimum flow at stage 85 through feed stem 159. Both shear and wetting characteristics (as well as other flow characteristics) could also be controlled by providing means for adjustment of the distance between the tapered ends of nozzles 95 and 119 and flow passageways 103 and 145.

Discharge pipe 139 can be made of a variety of different lengths, thorough wetting occurring within the straight portion of the discharge pipe (the longer the linear portion of the discharge pipe the more thorough the wetting provided therein).

The device illustrated in FIGS. 4 through 9 thus improves the self-conveying capability of the device as heretofore described, and is capable of operating through a wider pressure range, for example between 35 psi and 180 psi. As may be readily appreciated from FIG. 5, the device is readily disassembleable for cleaning and maintenance in the field, and allows improved control over both the wetting and shear rate imposed on substances of interest to be dispersed in their liquid phase.

The device as illustrated (wherein the nozzle bodies, for example, have a diameter of $3\frac{1}{2}$ inches by $2\frac{7}{8}$ inches in length with the venturi nozzles having an inside diameter of between $\frac{5}{8}$ inches and $\frac{3}{4}$ inches and a length of about 7 inches, and with the chambers having a maximum inside diameter of approximately $3\frac{3}{4}$ inches, with the feed stems having an inside diameter of approximately $\frac{3}{4}$ inch and the discharge pipe being formed of 1 inch pipe) has a practical throughput capacity range of between 15 gallons per minute and 40 gallons per minute at a maximum practical concentration of about 0.80% by weight. The components of the device can be made of any suitable materials, for example incline feed stems and nozzle, disperser, and discharge pipe bodies being formed of pvc, with the venturi nozzles being formed of Teflon. The discharge pipe is desirably a metal or pvc pipe. Other suitable materials known to those skilled in the art could of course be utilized.

Turning now to FIG. 10, wherein a schematic diagram is provided illustrating use of the device of this invention in a polymer preparation system for use in treating effluents to enhance removal of selected matter therefrom (all piping for transporting the various fluid materials between elements being indicated by solid lines), modular tank 167 includes bulk head 169 for dividing the tank into mixing tank section 171 and holding tank section 173. Polymer preparation system 175 (including the dispersing device of this invention) is connected to an automated drive polymer feed control system and includes substantially water-tight hopper-/auger/feeder 177, funnel eductor 15, dispersing device 81 (or dispersal eductor 17, device 81 being illustrated for purposes of this description), and related controls.

Clean water, which is preferred for polymer makeup, is supplied to the system through line 179 to centrifugal pump 181. Water supply to dispersing device 81 is initiated by pump 181 and the opening of electrically controlled valves 183 and 185 (connected to different ones of the feed stems 93 and 159 of dispersal stages 83 and 85). Opening of valves 183 and 185 to the degree selected to control shear and/or wetting is sensed and a control sequence is initiated starting dry polymer feed auger 177, determining the amount of polymer fed into dispersing device 81 through funnel eductor 15, sensing the adequacy of the water supply rate from pump 181, stopping the dry polymer feed after a predetermined processing time and continuing the water flow to clear device 81 (approximately 5 to 10 seconds) and thereafter stopping pump 181.

Water flow rate from valves 183 and 185 is controlled by flow regulators 187 and 189. Differential pressure sensor 191 is coupled to flow regulators 187 and 189 and monitors flow conditions, cutting off water flow and polymer feed in the event of improper flow conditions thus terminating the mix, and if desired, setting off an audible alarm, warning light or the like. Output of blended polymer and liquid through discharge pipe 139 may be forwarded to either tank 171 or 173 depending on desired utilization, for example as one input from tank 173 through pump 193 to mixer 195 for blending with effluents to be treated.

What is claimed is:

1. A method for dispersing a substance in a liquid comprising:

providing a flow of the substance;

spirally conducting a first liquid flow; introducing said flow of the substance into said first spiralling liquid flow;

spirally conducting a second liquid flow substantially counter-rotationally relative to said first spiralling liquid flow;

introducing said first liquid flow having the substance introduced therein into said second spiralling liquid flow; and independently regulating the flow of said first and second spiralling liquid flows.

2. The method of claim 1 wherein said characteristics are at least one of flow velocity and flow volume.

3. The method of claim 1 wherein the substance is substantially dry particles, and wherein the step of providing a flow of the substance includes the steps of inducing an air flow and distributing the particles in said air flow.

4. The method of claim 3 further comprising the step of controlling said air flow by adjusting selected said characteristics or either one of and both of said spiralling liquid flows.

5. A device for dispersing particles in a liquid comprising:

particle dispersing means for dispersing the particles in an air flow stream;

flow inducing and conducting means connected with said particle dispersing means for inducing said air flow stream through said particle dispersing means and for spirally conducting a liquid flow stream, said air flow stream having said particles therein being introduced into said spirally moving liquid flow stream at one part of said flow inducing and conducting means, said flow inducing and conducting means having an outlet;

a second flow conducting portion releasably connected with said outlet of said flow inducing and conducting means for spirally conducting a second liquid flow stream counter-rotationally relative to said liquid flow stream of said flow inducing and conducting means, the liquid having the particles introduced thereinto at said flow inducing and conducting means being introduced into said second spirally moving liquid flow stream at said second flow conducting portion; and regulating means connected with said flow inducing and conducting means and said second flow conducting portion for independently regulating the flow of said liquid flow streams.

6. The device of claim 5 wherein said flow inducing and conducting means includes a venturi nozzle having an outlet connected with said particle dispersing means for receiving said particles in said air flow stream therethrough, and a housing having an inner wall defining a cone with an outlet defined therein at a bottom part of said cone, said housing having a liquid feed stem opening into an upper part of said cone at a position so that liquid entering said cone through said feed stem is spirally directed by said cone toward said outlet.

7. The device of claim 6 wherein said housing includes a cone body and a nozzle body having said venturi nozzle positioned therethrough and having adjustment means positioned thereat, said nozzle body being slidably positionable in said cone body and adjustable therein by movement of said adjusting means to thereby adjust the position of said venturi nozzle outlet relative to said cone and said outlet therefrom.

8. The device of claim 5 wherein said particle dispersing means includes air flow directing means and a particle collector having an exit and an inlet connectable to a particle supply, said air flow directing means for directing air flow into said particle collector adjacent to said exit from said particle collector.

9. The device of claim 8 further comprising a breather cap having a rotatable portion for controlling said air flow through said air flow directing means.

10. A device for dispersing a substance in a liquid comprising:

a first dispersing stage including first liquid flow conducting means for spirally conducting a flow of liquid and having a liquid inlet and an outlet and first input means for conducting a flow of the substance, said first input means being connected with said first flow conducting means and having an outlet port positioned for introducing the substance into said spirally flowing liquid;

a second dispersing stage having second liquid flow conducting means for spirally conducting a flow of liquid and having a liquid inlet and an outlet and second input means connected to said outlet of said first liquid flow conducting means of said first dispersing stage and having an outlet port for introducing liquid having the substance introduced thereinto received from said first stage into said spirally flowing liquid at said second stage;

each of said first and second liquid flow conducting means including a liquid feed stem opening into a chamber having a conical portion, said feed stems being oriented to cause the spirally flowing liquid in said first liquid flow conducting means to be substantially counter-rotational relative to said spirally flowing liquid at said second liquid flow conducting means; and at least one of said first liquid flow conducting means and said first input means having adjustment means for adjusting the position of said outlet port of said first input means relative to said spirally flowing liquid at said first liquid flow conducting means.

11. The device of claim 10 further comprising flow adjusting means connected with said inlet of said first liquid flow conducting means for controlling liquid flow.

12. The device of claim 10 further comprising second adjusting means for independently adjusting the position of said outlet port relative to said spirally flowing liquid at said second dispersing stage.

13. The device of claim 10 further comprising first and second flow regulating means connected with said first and second liquid flow conducting means, respectively, for independently regulating liquid flow in said first and second liquid flow conducting means.

14. The device of claim 10 further comprising quick disconnect means for allowing disassembly of said means of said device.

15. A device for dispersing substantially dry particles in a liquid comprising:

a mounting body;

air funnelling means in said mounting body having an outlet for directing an airflow;

particle funnelling means in said mounting body for receiving said particles and having said outlet of said air funnelling means positioned adjacent thereto, said particle funnelling means having an outlet;

air flow control means connected with said mounting body for selectively controlling air flow to said air funnelling means;

a first housing having an inner wall defining a cone, an outlet defined therein at a bottom part of said cone and a liquid feed stem mounted at an incline relative to perpendicular from the longitudinal axis of said cone and opening into an upper part of said cone at a position so that liquid entering said cone through said feed stem is spirally directed in said cone toward said outlet;

a first nozzle connected with said outlet of said particle funnelling means and received through said housing and having an outlet port positionable adjacent to said bottom part of said cone of said first housing;

a second housing having an inner wall defining a cone, an outlet defined therein at a bottom part of said cone and a liquid feed stem opening into an upper part of said cone at a position so that liquid entering said cone through said feed stem is spirally directed in said cone toward said outlet counter-rotationally relative to spirally directed liquid flow in said first housing; and a second nozzle connected with said outlet of said first housing and having an outlet port positionable adjacent to said bottom part of said cone of said second housing.

16. The device of claim 15 wherein each of said housings include a nozzle body having one of said nozzles positioned therethrough and a cone body having said nozzle body slidably positionable therein, said device further comprising adjustment means for slidably moving at least one of said nozzle bodies longitudinally in said cone body to thereby adjust the position of one of said outlet ports of said nozzles relative to said bottom part of one of said cones.

17. The device of claim 15 wherein said air flow control means includes a breather cap having a rotatable portion and a stationary portion, each of said portions having an aperture therein.

18. The device of claim 15 wherein said outlet from said air funnelling means is positioned adjacent to said outlet from said particle funnelling means, said particle funnelling means having an upper conical portion adjacent to said outlet thereof, whereby said air flow directed by said air funnelling means forms said particles into a ring-shaped flow around said conical portion of said particle funnelling means and adjacent to said outlet therefrom.

* * * * *